US008465332B2

(12) United States Patent
Hogan et al.

(10) Patent No.: US 8,465,332 B2
(45) Date of Patent: Jun. 18, 2013

(54) CONTACT ASSEMBLY FOR AN ELECTRICAL CONNECTOR

(75) Inventors: Kevin Matthew Hogan, Reading, PA (US); Dwight David Zitsch, Marysville, PA (US); Matthew Richard McAlonis, Elizabethtown, PA (US); Albert Tsang, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 238 days.

(21) Appl. No.: 13/006,010

(22) Filed: Jan. 13, 2011

(65) Prior Publication Data

US 2012/0184156 A1 Jul. 19, 2012

(51) Int. Cl.
*H01R 13/40* (2006.01)

(52) U.S. Cl.
USPC ..... 439/733.1

(58) Field of Classification Search
USPC ..... 439/680, 733.1, 744, 839–843, 851, 439/884
See application file for complete search history.

(56) References Cited

U.S. PATENT DOCUMENTS 4,278,317 A 7/1981 Gallusser et al.
4,921,456 A * 5/1990 French ..... 439/851
5,108,318 A * 4/1992 Sakurai et al. ..... 439/744
5,516,310 A 5/1996 Sawada
6,994,600 B2 * 2/2006 Coulon ..... 439/843
7,467,980 B2 * 12/2008 Chiu ..... 439/843

FOREIGN PATENT DOCUMENTS

EP 0025368 A1 3/1981
WO 9815036 A1 4/1998

OTHER PUBLICATIONS

International Search Report, International Application No. PCT/US 2012/000019, International Filing Date, Sep. 1, 2012.

* cited by examiner

*Primary Examiner* — Edwin A. Leon

(57) ABSTRACT

An electrical contact assembly is provided. The assembly includes a contact hood having a body including an axis and an opening extending through the body along the axis. The opening has an inner surface. The contact hood is configured to be received in an opening of a connector housing. At least two protrusions are formed on the inner surface of the contact hood opening. An electrical contact is provided having a body including a contact end and a socket end. The socket end is inserted axially into the opening of the contact hood. The contact end of the electrical contact is configured to extend from a mating end of the connector housing. At least two apertures are formed on the socket end of the electrical contact. The at least two protrusions are received in the at least two apertures to secure the electrical contact within the contact hood.

20 Claims, 8 Drawing Sheets

CONTACT ASSEMBLY FOR AN ELECTRICAL CONNECTOR

BACKGROUND OF THE INVENTION

The subject matter herein relates generally to electrical connectors and, more particularly, to a contact assembly for an electrical connector.

Electrical connectors generally include a connector housing that is configured to engage a corresponding housing of a mating connector or the like. The connector housing includes electrical contacts positioned within the housing. The electrical contacts electrically couple to electrical contacts in the mating connector. The electrical contacts include a contact end and a socket end. The contact end extends from the connector housing to engage the mating connector. The socket end is secured within the contact housing. The socket end is typically inserted into a contact hood that protects the electrical connector and secures the electrical connector to the connector housing. The socket end may be retained within the contact hood through an interference fit.

However, electrical contacts are not without disadvantages. Typically, the interference fit between the socket end of the electrical contact and the contact hood allows movement of the electrical contact within the contact hood. Accordingly, the electrical contacts are subject to misalignment within the contact hood. Misalignment of the electrical contacts may result in poor connections with the mating connector. A poor connection may damage the connector and/or any devices joined to the connector.

Additionally, the electrical contact may become disengaged from the contact hood. When disengaged, the electrical contact may come in contact with other electrical contacts, thereby causing shorts in the other contacts within the connector. Shorts in the connector may damage the connector and/or any device joined to the connector.

A need remains for an electrical contact that properly secures in a contact hood to prevent the contact from misaligning within the hood and/or becoming disengaged from the hood.

SUMMARY OF THE INVENTION

In one embodiment, an electrical contact assembly is provided. The assembly includes a connector housing having a body with a mating end and a wire end. An opening extends through the body from the mating end to the wire end. A contact hood is provided having a body including an axis and an opening extending through the body along the axis. The opening has an inner surface including at least two hood fasteners. The contact hood is received in the opening of the connector housing. An electrical contact is provided having a body including a contact end and a socket end. The socket end has at least two contact fasteners. The socket end is inserted axially into the opening of the contact hood so that the at least two hood fasteners engage the at least two contact fasteners to secure the electrical contact within the contact hood. The contact end of the electrical contact configured to extend from the mating end of the connector housing and connect to a contact of a mating connector.

In another embodiment, an electrical contact assembly is provided. The assembly includes a contact hood having a body including an axis and an opening extending through the body along the axis. The opening has an inner surface. The contact hood is configured to be received in an opening of a connector housing. At least two protrusions are formed on the inner surface of the contact hood opening. An electrical contact is provided having a body including a contact end and a socket end. The socket end is inserted axially into the opening of the contact hood. The contact end of the electrical contact is configured to extend from a mating end of the connector housing. At least two apertures are formed on the socket end of the electrical contact. The at least two protrusions are received in the at least two apertures to secure the electrical contact within the contact hood.

In another embodiment, an electrical contact assembly is provided. The assembly includes a contact hood having a body including an axis and an opening extending through the body along the axis. The opening has an inner surface including a circumference. The contact hood is configured to be received in an opening of a connector housing. At least two contact fasteners are formed on the inner surface of the contact hood opening. The at least two hood fasteners are equally spaced around the circumference of the inner surface of the contact hood. An electrical contact is provided having a body including a contact end and a socket end. The socket end is inserted axially into the opening of the contact hood. The contact end of the electrical contact is configured to extend from a mating end of the connector housing. At least two contact fasteners are formed on the socket end of the electrical contact. The at least two hood fasteners engaging the at two contact fasteners to secure the electrical contact within the contact hood.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
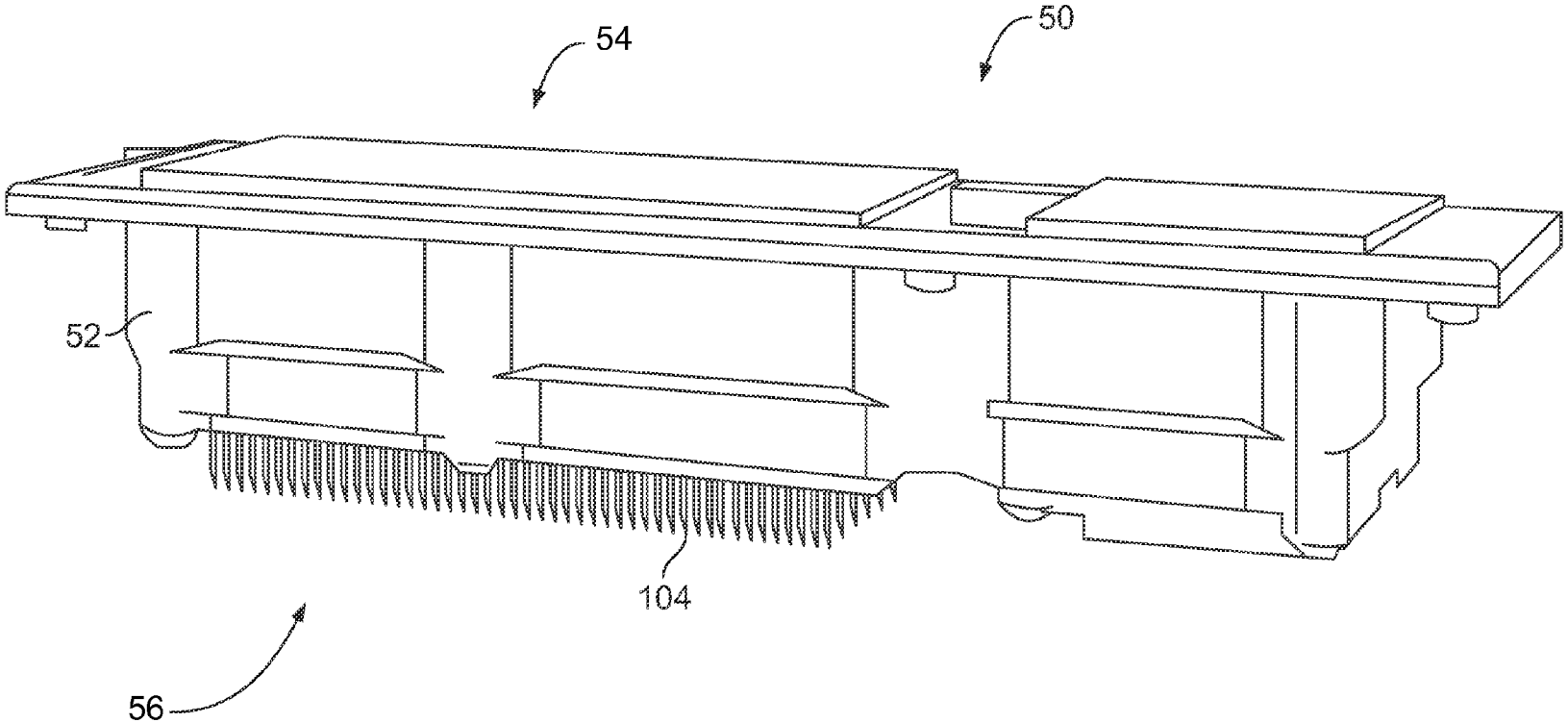
FIG. 1 is a perspective view of an electrical connector formed in accordance with an embodiment.

FIG. 1 illustrates an electrical connector 50 formed in accordance with an embodiment. In one embodiment, the electrical connector 50 may be used in an aerospace application. Alternatively, the electrical connector 50 may be used in any suitable electrical application. The electrical connector 50 includes a connector housing 52 having a mating end 54 and a wire end 56. The wire end 56 is joined to a cable (not shown) that carries power and/or data signals therethrough. The cable includes wires extending therethrough. The wire end 56 of the housing 52 includes electrical contacts 104 extending therefrom. The electrical contacts 104 are electrically joined to the wires of the cable. The electrical contacts 104 carry data and/or power signals. The electrical contacts 104 are configured to be received in a mating connector (not shown). The electrical contacts 104 channel the data and/or power signals from the electrical connector 50 to the mating connector. In one embodiment, the electrical contacts 104 are retained within the connector 50 with contact hoods (not shown).

Figure 2:
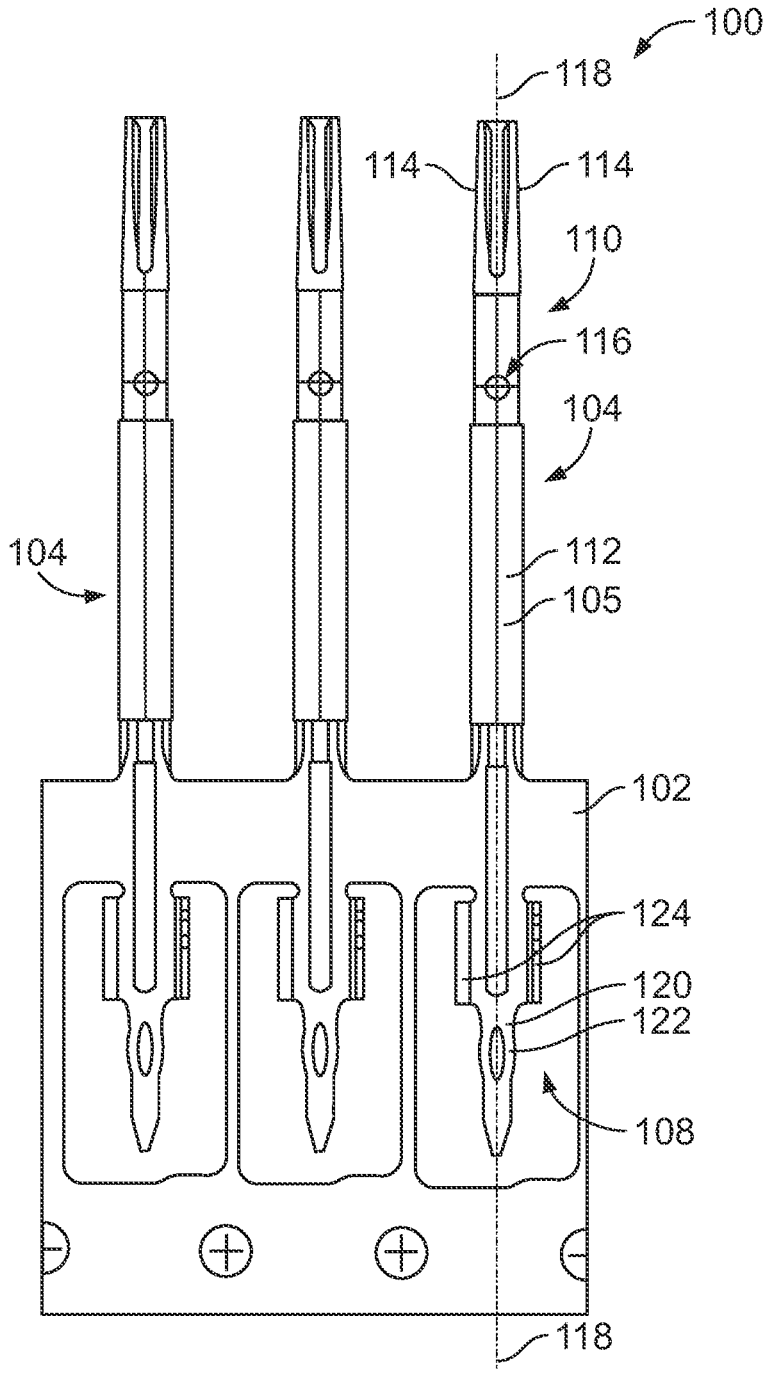
FIG. 2 is a top view of a contact carrier assembly formed in accordance with an embodiment.

FIG. 2 illustrates a contact carrier assembly 100 formed in accordance with an embodiment. The contact carrier assembly 100 includes a carrier plate 102 used to form the electrical contacts 104 of the electrical connector 50. The electrical contacts 104 are stamped and formed with the carrier plate 102. Multiple contacts 104 are formed at the same time. The multiple contacts 104 are stamped as blanks from the carrier plate 102. The blanks may be formed into the contacts 104 while remaining connected to the carrier plate 102. The contacts 104 are then separated from the carrier plate 102. Alternatively, the blanks may be removed from the carrier plate 102 prior to forming the contacts 104. After being removed from the contact carrier assembly 100, the electrical contacts 104 may be inserted into the electrical connector 50.

Each contact 104 includes a body 106 having a contact end 108 and a socket end 110. The body 106 may be circular and include a circumference. Alternatively, the body 106 may have any shape forming a perimeter around the body 106. An intermediate body portion 112 extends between the contact end 108 and the socket end 110. The body 106 extends along an axis 118 from the contact end 108 to the socket end 110. The socket end 110 is configured to be inserted axially into the connector housing 52 (shown in FIG. 1). The socket end 110 is configured to electrically couple to wires and/or contacts within the connector housing 52. The socket end 110 includes a pair of tines 114. The tines 114 are configured to electrically couple to the wires and/or contacts within the connector housing 52.

Figure 3:
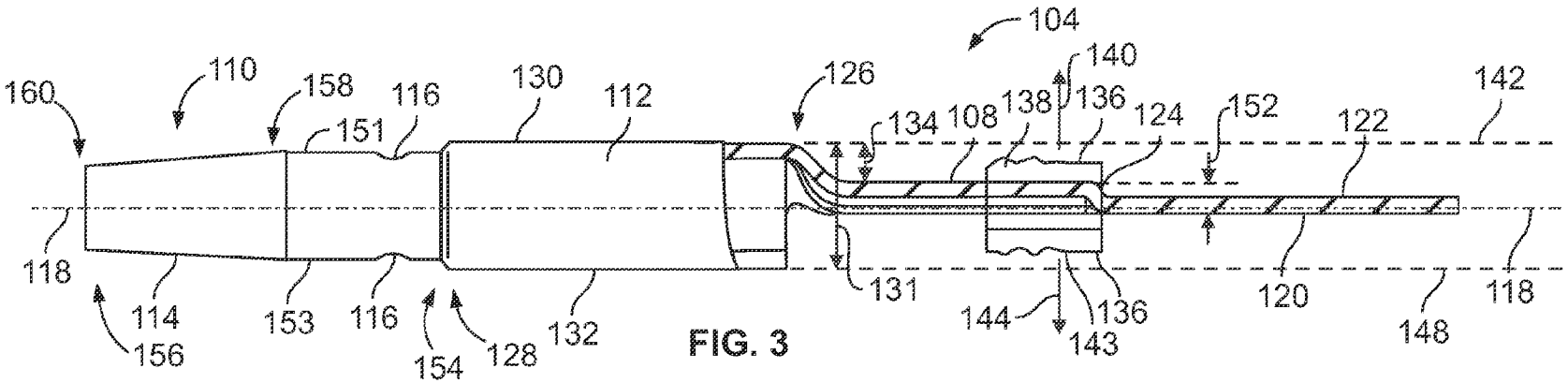
FIG. 3 is a side view of a contact formed in accordance with an embodiment.

The socket end 110 includes contact fasteners 116. FIG. 2 illustrates a single contact fastener 116 on the top of the contact 104. In an exemplary embodiment, the contact 104 includes a second contact fastener 116 on the bottom (not shown) of the contact 104. The pair of contact fasteners is illustrated in FIG. 3. Alternatively, the contact 104 may include more than two contact fasteners 116. The contact fasteners 116 are positioned between the tines 114 and the intermediate body portion 112 of the contact 104. In the illustrated embodiment, the contact fasteners 116 are positioned proximate to the intermediate body portion 112. Alternatively, the contact fasteners 116 may be positioned proximate to the tines 114. In another embodiment, the contact fasteners 116 may be positioned at any intermediate location between the intermediate body portion 112 and the tines 114.

The contact end 108 of the contact 104 is configured to engage a corresponding contact of a mating connector (not shown). The contact end 108 includes a connector 120 having engagement features 122. The engagement features 122 extend from the connector 120. An engagement feature 122 is provided on opposite sides of the connector 120. The engagement features 122 are spaced 180 degrees apart. Alternatively, the connector 120 may only include one engagement feature 122. In another embodiment, the connector 120 includes any number of engagement features 122. The engagement features 122 are equally spaced about the connector 120. Alternatively, the engagement features 122 may have any spacing about the connector 120.

The connector 120 is formed as an eye-of-the-needle connector. Alternatively, the connector 120 may have any suitable configuration. For example, the connector may be formed as a solder tail connector, a crimp contact, or the like. The connector 120 is configured to be press-fit into a contact opening (not shown) of the mating connector. The connector 120 may be retained within the contact opening by friction. In one embodiment, the engagement features 122 deform to create an interference fit with the contact opening. In another embodiment, the contact opening deforms to receive the connector 120. Alternatively, both the engagement features 122 and the contact opening deform. In one embodiment, the connector 120 may include grooves, notches, or the like to retain the connector 120 within the contact opening. Alternatively, the connector 120 may be retained within the contact opening with a latch and/or other suitable locking mechanism.

The contact end 108 includes engagement flanges 124 extending therefrom. The engagement flanges 124 are positioned between the connector 120 and the intermediate body portion 112. In the illustrated embodiment, the engagement flanges 124 are positioned proximate to the connector 120. Alternatively, the engagement flanges 124 may be positioned proximate to the intermediate body portion 112. In another embodiment, the engagement flanges 124 may be positioned at any intermediate location between the connector 120 and the intermediate body portion 112. An engagement flange 124 extends from each side of the contact end 108. The engagement flanges 124 are positioned 180 degrees apart around the contact end 108. In one embodiment, the contact end 108 may include only one engagement flange 124. Alternatively, the contact end may include any number of engagement flanges 124. The engagement flanges 124 may be equally spaced about the contact end 108. Alternatively, the engagement flanges 124 may have any spacing about the contact end 108.

The engagement flanges 124 are configured to form an interference fit with the mating connector. The engagement flanges 124 may deform to create a press-fit with an opening of the mating connector. Alternatively, the opening of the mating connector may deform to receive the engagement flanges 124. In another embodiment, both the engagement flanges 124 and the opening of the mating connector deform to create a press-fit. The engagement flanges 124 may include grooves, notches, protrusions, or the like that engage corresponding features on the mating connector.

FIG. 3 is a side view of a contact 104. The intermediate body portion 112 includes a front end 126 and a back end 128. The intermediate body portion 112 includes a top 130 and a bottom 132. The axis 118 extends through the contact 104 from the front end 126 to the back end 128. The intermediate body portion 112 may be tubular in shape and have a circumference extending thereround. Alternatively, the intermediate body portion 112 may have any suitable shape having a perimeter. The intermediate body portion 112 has a uniform height 131 along the axis 118 defined between the top 130 and the bottom 132. In another embodiment, the intermediate body portion 112 may taper outward from the axis 118 towards the front end 126 and/or the back end 128. In one embodiment, the intermediate body portion 112 may taper outward from the axis 118 from the front end 126 and/or the back end 128.

The contact end 108 extends from the front end 126 of the intermediate body portion 112. The contact end 108 steps down a distance 134 from the top 130 of the intermediate body portion 112. Alternatively, the contact end 108 may step up from the bottom 132 of the intermediate body portion 112. The contact end 108 extends along the axis 118. Alternatively, the contact end 108 extends parallel to the axis 118. The contact end 108 has a flat configuration. Alternatively, the contact end 108 may be formed as a cylinder having a circumference. In another embodiment, the contact end 108 has any shape having a perimeter.

The engagement flanges 124 extend from the contact end 108. The engagement flanges 124 include ribs 136 that extend outward from the engagement flange 124. In one embodiment, a first rib 138 extends upward from an engagement flange 124 in a first direction 140. The first rib 138 extends between the contact end 108 and a line 142 defined by the top 130 of the intermediate body portion 112. A second rib 144 extends downward from another engagement flange 124 in a second direction 146. The second rib 144 extends between the contact end 108 and a line 148 defined by the bottom 132 of the intermediate body portion 112. In one embodiment, the contact end 108 includes only one rib 136 extending upward or downward. In another embodiment, the contact end 108 includes any number of ribs 136 extending upward, downward, and/or outward. In one embodiment, both ribs 138 and 144 extend from the same engagement flange 124.

The connector 120 of the contact end 108 steps down a distance 152 proximate to the engagement flanges 124. The connector 120 may extend along the axis 118. Alternatively, the connector 120 extends parallel to the axis 118. The connector 120 has a flat configuration. Alternatively, the connector 120 may have a cylindrical configuration having a circumference. In another embodiment, the connector 120 has any shape having a perimeter. The connector 120 includes the engagement features 122. The engagement features 122 extend outward from the connector 120 within the same plane as the connector 120. Alternatively, the engagement features 122 may extend upward and/or downward from the connector 120.

The socket end 110 of the contact 104 extends from the back end 128 of the intermediate body portion 112. The socket end 110 may extend along the axis 118. Alternatively, the socket end 110 may extend parallel to the axis 118. The socket end 110 includes a front end 154 and a back end 156. The front end 154 is joined to the back end 128 of the intermediate body portion. The tines 114 extend proximate to the back end 156 of the socket end 110. The tines 114 include a front end 158 and a back end 160. The back end 160 is positioned at the back end 156 of the socket end 110. The tines 114 taper inward toward the axis 118 from the front end 158 to the back end 160. Alternatively, the tines 114 may taper outward from the back end 160 to the front end 158.

The socket end 110 includes a top 151 and a bottom 153. The socket end 110 includes two contact fasteners 116. One of the contact fasteners 116 is located at the top 151 of the socket end 110. The other contact fastener 116 is located at the bottom 153 of the socket end 110. The contact fasteners 116 are configured to secure the hood 180 to the socket end 110 such that it can be properly installed within the connector 50. The contact fasteners 116 are aligned along the axis 118 of the contact 104. Alternatively, the contact fasteners 116 may be offset along the axis 118 of the contact 104. In one embodiment, the socket end 110 of the contact 104 may include more than one contact fastener 116 on the top 151 and/or the bottom 153 of the socket end 110. Optionally, the socket end 110 may include contact fastener 116 at intermediate locations between the top 151 and the bottom 153 of the socket end 110.

Figure 4:
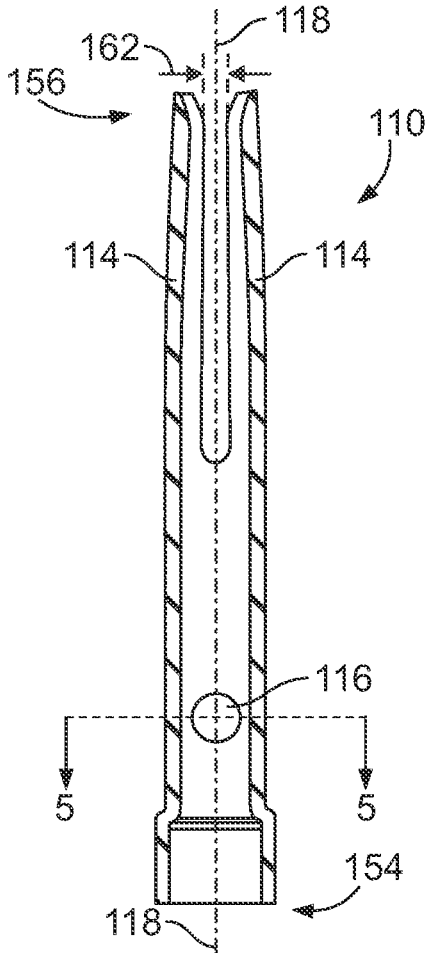
FIG. 4 is top view of a socket end of a contact formed in accordance with an embodiment.

FIG. 4 is top view of a socket end 110 of a contact 104. The socket end 110 includes the front end 154 and the back end 156. The tines 114 extend proximate to the back end 156. The illustrated embodiment shows a pair of tines 114 having a gap 162 therebetween. Alternatively, the socket end 110 may include any number of tines 114. The tines 114 may be evenly spaced about a circumference of the socket end 110. Alternatively, the tines 114 may be evenly spaced about a perimeter of a non-circular socket end 110. In the illustrated embodiment, the tines 114 are spaced 180 degrees apart about the circumference of the circular socket end 110. The tines 114 are positioned on opposite sides of the socket end 114. Alternatively, the tines 114 may be spaced at any distance apart around the circumference or perimeter of the socket end 114. For example, the tines 114 may be non-uniformly spaced about the circumference of the circular socket end 110.

The tines 114 are configured to engage a wire and/or contact of the electrical connector 50. The tines 114 are electrically coupled to the cable 58. The tines 114 receive and carry data and/or power signals through the electrical contact 104. The tines 114 may be inserted into a corresponding contact within the electrical connector 50. The tines 114 may attach to the wires 59 (shown in FIG. 1) within the electrical connector 50. For example, a wire 59 within the electrical connector 50 may be wrapped around or otherwise secured to the tines 114. Alternatively, a wire 59 may be positioned between the tines 114. When the socket end 110 of the contact 104 is inserted into the connector 50, the tines 114 move together to secure the wire 59 within the gap 162.

The contact fasteners 116 are provided between the front end 154 and the back end 156 of the socket end 110. The contact fasteners 116 may be positioned at any intermediate location between the front end 154 and the back end 156 of the socket end 110. In the illustrated embodiment, the contact fasteners 116 are positioned between the front end 154 of the socket end 110 and the tines 114. The contact fasteners 116 are formed as an aperture that extends through the socket end 110. In the illustrated embodiment, the contact fastener 116 is formed as a circular aperture. In alternative embodiments, the contact fastener 116 may have any shape. Alternatively, the contact fasteners 116 may be formed as grooves, notches, protrusions, or the like.

Figure 5:
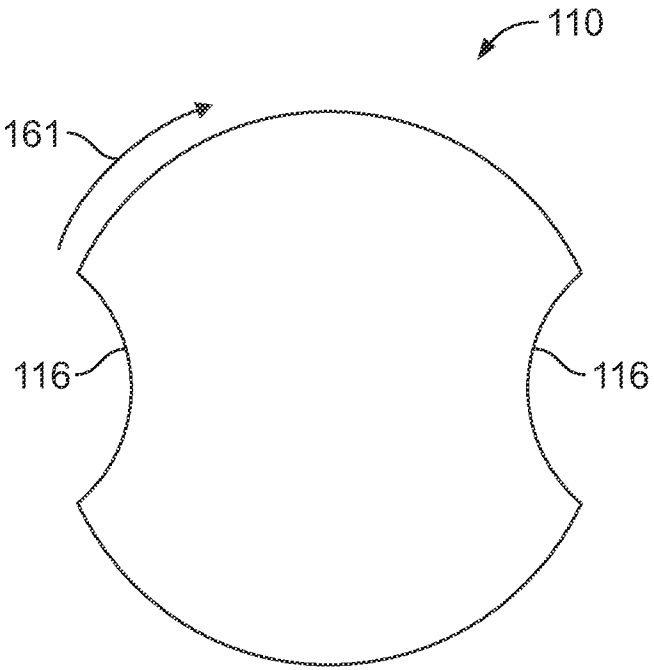
FIG. 5 is a cross-sectional view of the socket end shown in FIG. 4 taken about line 5.

FIG. 5 illustrates a cross-sectional view of the socket end 110 taken along line 5 in FIG. 4. The socket end 110 includes a circumference 161. FIG. 5 illustrates the socket end 110 having two contact fasteners 116. The contact fasteners 116 are evenly spaced about the circumference 161 of the socket end 110. In the illustrated embodiment, the two contact fasteners 116 are spaced 180 degrees apart around the circumference 161 of the socket end 110. Alternatively, the socket end 110 may include more than two contact fasteners 116. For example, three contact fasteners 116 may be spaced 120 degrees about the socket end 110. In one embodiment, the contact fasteners 116 may be spaced evenly about a perimeter of a non-circular socket end 110.

Figure 6:
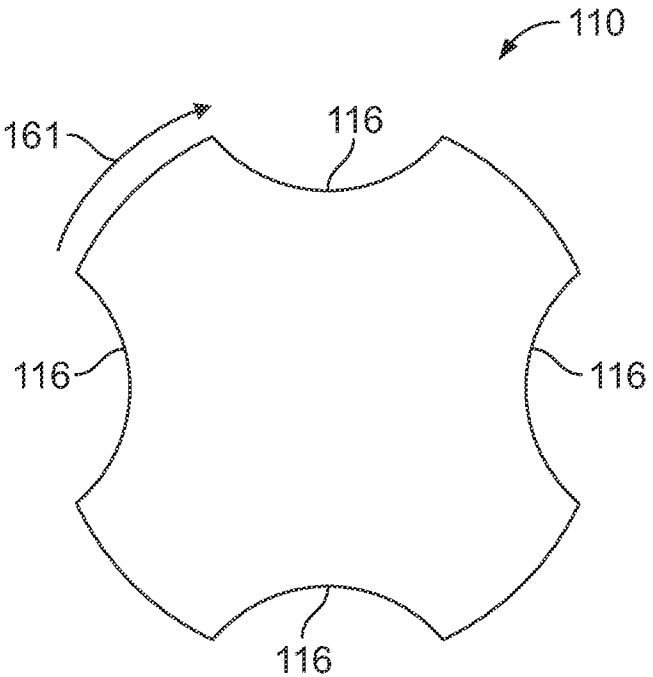
FIG. 6 is a cross-sectional view of an alternative socket end formed in accordance with an embodiment.

FIG. 6 illustrates the socket end 110 having four contact fasteners 116 spaced about the circumference 161 of the socket end 110. The four contact fasteners 116 are evenly spaced about the circumference 161 of the socket end 110. In the illustrated embodiment, the contact fasteners 116 are spaced 90 degrees about the socket end 110. In one embodiment, the contact fasteners 116 may not be evenly spaced about the circumference 161 of the socket end 110.

By utilizing at least two contact fasteners 116, the contact 104 may be uniformly retained within the connector 50. The contact fasteners 116 provide retention forces on the contact 104 around the circumference 161 of the socket end 110. The contact fasteners 116 may be evenly spaced to provide a uniform retention force around the circumference 161 of the contact 104. A retention force is applied to each of the contact fasteners 116. The contact 104 may experience outside forces, for example, forces on the connector 50. The forces on the connector 50 may be imposed at an angle with respect to the axis 118 of the contact. The uniform retention force provided by the contact fasteners 116 prevents the contact from becoming misaligned within the connector 50 due to the forces on the connector 50. The contact fasteners 116 also prevent the contact from being dislodged from the connector 50 when experiencing an angular force with respect to the axis 118 of the contact 104.

Figure 7:
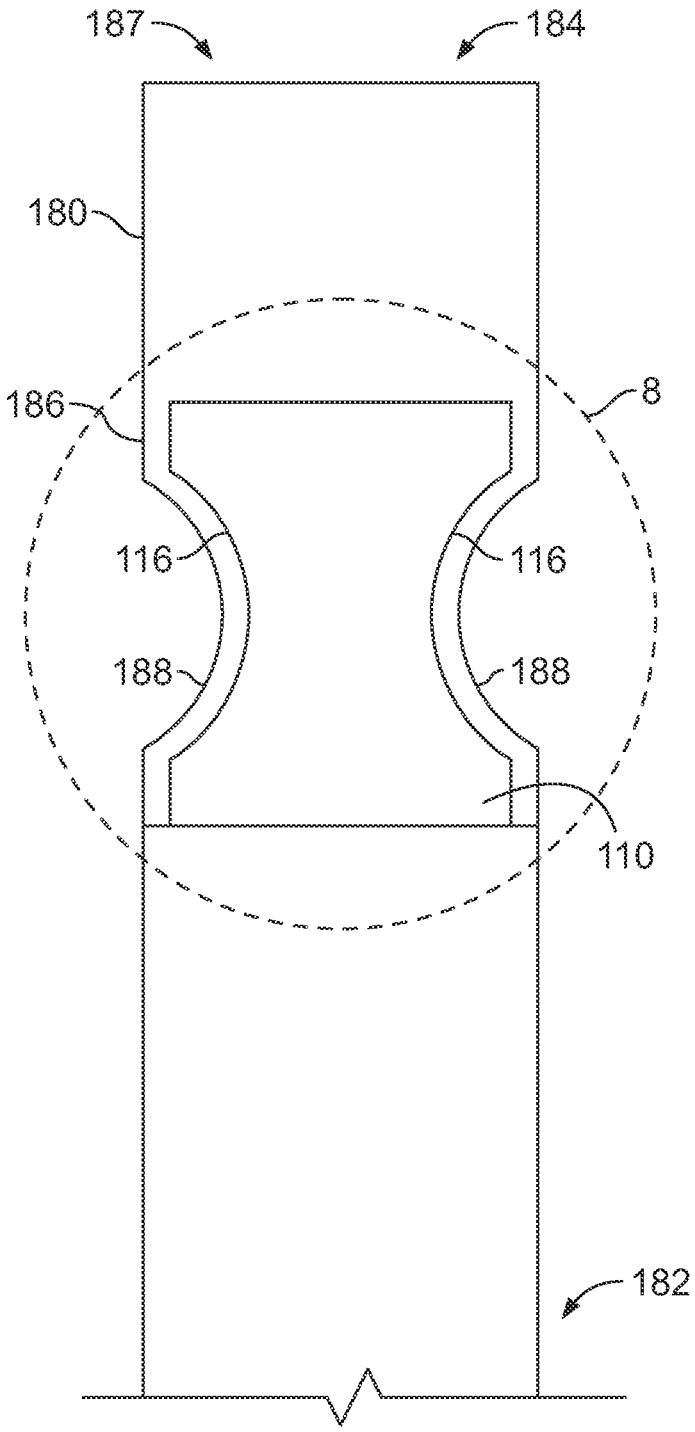
FIG. 7 is a top view of a socket end of a contact formed in accordance with an embodiment and having a contact hood joined thereto.

FIG. 7 illustrates the socket end 110 inserted into a contact hood 180. The contact hood 180 includes a front end 182 and a back end 184. The contact hood 180 has a hollow body 186 having an opening 187 extending from the front end 182 to the back end 184. The contact hood 180 is configured to retain the contact 104 in the openings 60 (shown in FIG. 1) of the connector housing 52 (shown in FIG. 1). The socket end 110 of the contact 104 is axially inserted into the opening 187 of the hollow body 186. A cutout 8 illustrates the mechanical engagement between the contact hood 180 and the contact 104. A pair of hood fasteners 188 is positioned within the hollow body 186. The hood fasteners 188 are aligned with the contact fasteners 116. The hood fasteners 188 engage the contact fasteners 116 of the socket end 110 to retain the contact 104 within the contact hood 180.

Figure 8:
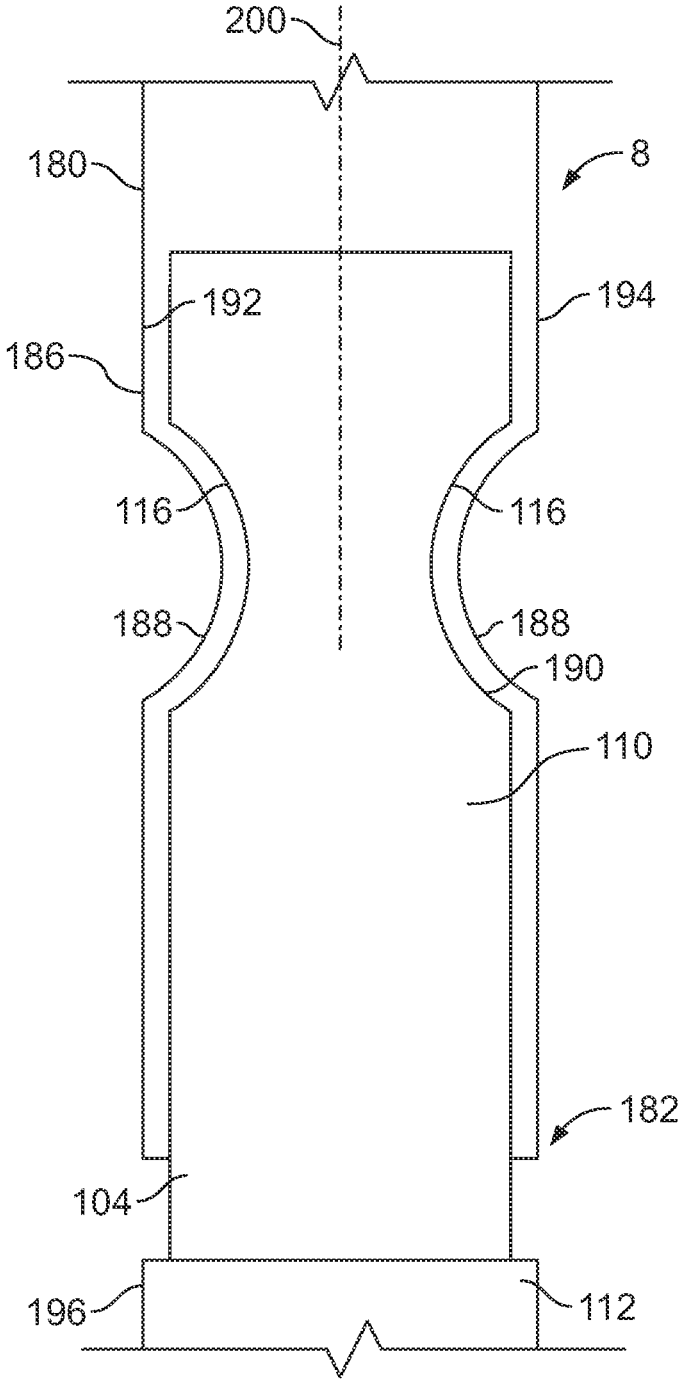
FIG. 8 is an exploded view of the area 8 shown in FIG. 7.

FIG. 8 is an exploded view of the area 8. The socket end 110 of the electrical contact 104 is positioned within the contact hood 180. The socket end 110 includes an outer surface 190. The contact hood 180 includes an inner surface 192 and an outer surface 194. The socket end 110 is inserted axially into the contact hood 180 so that the inner surface 192 of the contact hood 180 abuts the outer surface 190 of the socket end 110. The front end 182 of the contact hood 180 is positioned adjacent the intermediate body portion 112 of the contact 104. In one embodiment, the front end 182 of the contact hood 180 may abut the intermediate body portion 112. Alternatively, the contact hood 180 may overlap a portion of the intermediate body portion 112. The intermediate body portion 112 includes an outer surface 196. The outer surface 194 of the contact hood 180 may be positioned flush with the outer surface 196 of the intermediate body portion 112. In another embodiment, the outer surface 194 of the contact hood 180 is not positioned flush with the outer surface 196 of the intermediate body portion 112. In one embodiment, the intermediate body portion 112 may include attachment features, such as grooves, notches, apertures, tabs, latches, or the like to engage a corresponding feature on the contact hood 180.

The socket end 110 includes two contact fasteners 116. The contact fasteners 116 are formed as apertures that extend through the outer surface 190 of the socket end 110. The contact fasteners 116 may extend partially through the socket end 110. Alternatively, the contact fasteners 116 extend entirely through the socket end 110. The electrical contacts fasteners 116 are formed as apertures having a circular shape. Alternatively, the contact fasteners 116 may be formed as apertures having any shape. In another embodiment, the contact fasteners 116 may be formed as a notch, groove, tab, or the like that is configured to engage a corresponding feature on the contact hood 180. The contact fasteners 116 are equally spaced 180 degrees about the circumference of the socket end 110.

The contact hood 180 includes an axis 200. The hood fasteners 188 extend from the inner surface 192 of the contact hood 180 toward the axis 200. The hood fasteners 188 are configured to be retained within the contact fasteners 116. The hood fasteners 180 are formed as protrusions. The hood fasteners 180 have an arcuate shape. Alternatively, the hood fasteners 180 may have any shape that is capable of being received within a contact fastener 116. The hood fasteners 188 are positioned 180 degrees apart around the circumference of the contact hood 180. The hood fasteners 188 are spaced to correspond to the spacing of the contact fasteners 116 of the contact 104. The contact hood 180 may include any number of hood fasteners 188. In one embodiment, the contact 104 has at least as many contact fasteners 116 as the contact hood 180 has hood fasteners 188. The hood fasteners 188 and the contact fasteners 116 form a symmetrical force on the contact 104.

Figure 9:
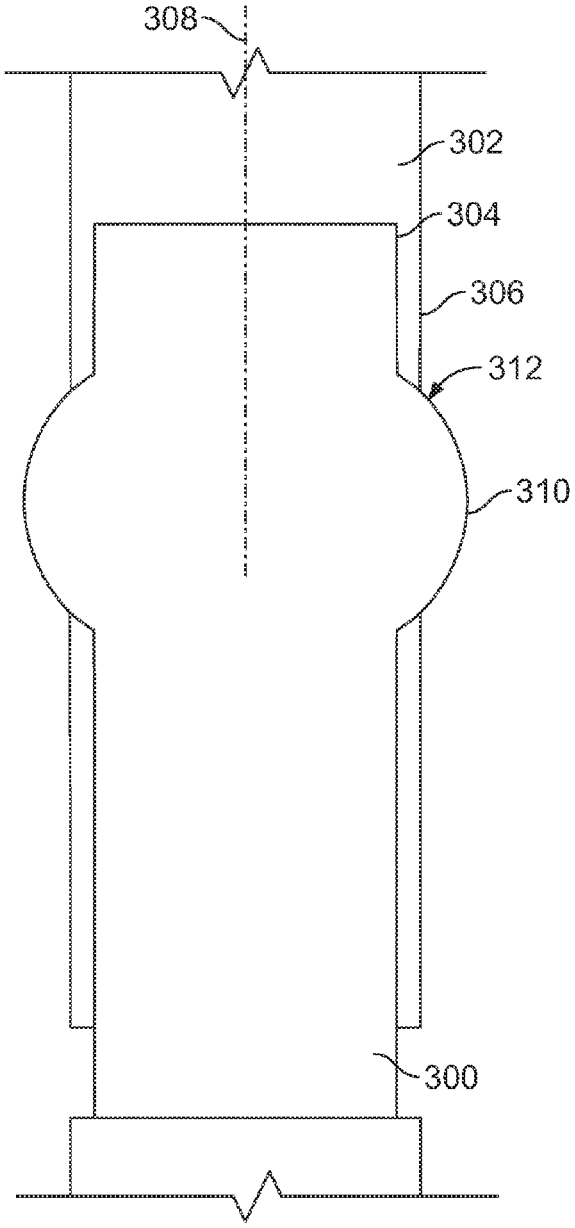
FIG. 9 is an exploded view of an alternative socket end formed in accordance with an embodiment and having a contact hood joined thereto.

FIG. 9 illustrates an alternative socket end 300 having a contact hood 302 joined thereto. The socket end 300 includes an outer surface 304. The contact hood 302 includes an inner surface 306. The socket end 300 is inserted axially into the contact hood 302 so that the outer surface 304 of the socket end 300 abuts the inner surface 306 of the contact hood 302.

The socket end 300 includes an axis 308. Contact fasteners 310 extend from the outer surface 304 of the socket end 300. The contact fasteners 310 extend outward from the axis 308 of the socket end 300. The contact fasteners 310 are formed as protrusions having an arcuate shape. Alternatively, the contact fasteners 310 may have any suitable shape. The contact fasteners 310 are evenly spaced about the socket end 110.

The contact hood 302 includes hood fasteners 312 extending therethrough. The hood fasteners 312 are formed as apertures that are sized to receive the contact fasteners 310 of the socket end 300. The hood fasteners 312 are evenly spaced about the contact hood 302. The hood fasteners 312 are spaced to align with the contact fasteners 310 of the socket end 110. The hood fasteners 312 engage the contact fasteners 310 of the socket end 110 to retain the socket end 110 within the contact hood 302.

Figure 10:
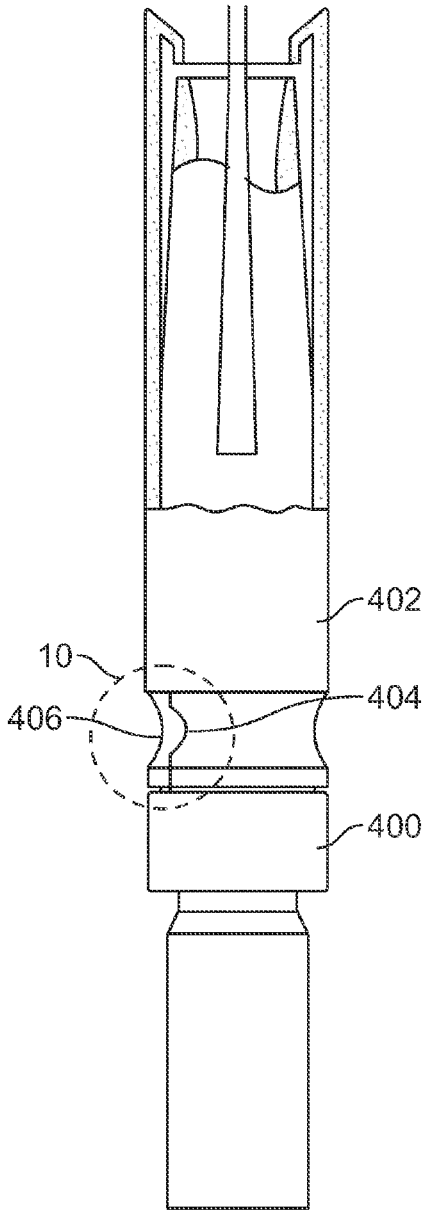
FIG. 10 is a side view of an alternative socket end formed in accordance with an embodiment and having a contact hood joined thereto.

FIG. 10 illustrates an alternative socket end 400 having a contact hood 402 joined thereto. FIG. 10 includes a cutout 10 showing the engagement between the socket end 400 and the contact hood 402. The socket end 400 includes a contact fastener 404 extending thereround. The contact fastener 404 is formed as a recess that extends around the circumference of the socket end 400. The contact fastener 404 extends symmetrically around the socket end 400. The contact hood 402 includes a hood fastener 406 extending thereround. The hood fastener 406 is formed as a recess that extends around the circumference of the contact hood 402. The hood fastener 406 extends symmetrically around the circumference of the contact hood 402. The hood fastener 406 engages the contact fastener 404 to retain the contact hood 402 on the socket end 400.

The present embodiment includes multiple contact fasteners and corresponding hood fasteners. The fasteners align the contacts with contacts of a corresponding mating connector. The fasteners may be equally spaced about the contact and the contact hood. The fasteners provide uniform retention of the contact within a contact hood about a perimeter of the contact. The fasteners prevent the contact from becoming dislodged from the contact hood due to angular forces on the contact.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical contact assembly comprising:

a connector housing having a body with a mating end and a wire end, an opening extending through the body from the mating end to the wire end;

a contact hood having a body including an axis and an opening extending through the body along the axis, the contact hood having at least two hood fasteners preformed on the contact hood, the contact hood received in the opening of the connector housing; and an electrical contact having a body including a contact end and a socket end, the socket end having at least two contact fasteners preformed on the electrical contact, the socket end inserted axially into the opening of the contact hood so that the at least two preformed hood fasteners engage the at least two preformed contact fasteners to secure the electrical contact within the contact hood, the contact end of the electrical contact configured to extend from the mating end of the connector housing and connect to a contact of a mating connector, wherein the preformed hood fasteners and preformed contact fasteners being formed prior to inserting the electrical contact into the contact hood.

2. The assembly of claim 1, wherein the at least two hood fasteners are equally spaced around a circumference of the contact hood and the at least two contact fasteners are equally spaced around a circumference of the socket end of the electrical contact.

3. The assembly of claim 1 comprising two hood fasteners spaced 180 degrees around a circumference of the contact hood, and two contact fasteners spaced 180 degrees around a circumference of the socket end of the electrical contact.

4. The assembly of claim 1, wherein the at least two hood fasteners are formed as protrusions that extend toward the axis of the contact hood body.

5. The assembly of claim 1, wherein the at least two contact fasteners are formed as apertures extending through the body of the electrical contact that receive the hood fasteners of the contact hood.

6. The assembly of claim 1, wherein the at least two hood fasteners are equally spaced around a circumference of the contact hood to provide a symmetrical coupling force on the electrical contact.

7. The assembly of claim 1, wherein the socket end of the electrical contact includes tines configured to receive at least one of a wire or a contact.

8. The assembly of claim 1, wherein the contact hood is configured to align the electrical contact with the contact of the mating connector.

9. The assembly of claim 1, wherein the at least two hood fasteners are formed as apertures extending through the body of the contact hood and the at least two contact fasteners are formed as protrusions.

10. An electrical contact assembly comprising:

a contact hood having a body including an axis and an opening extending through the body along the axis, the opening having an inner surface, the contact hood configured to be received in an opening of a connector housing;

at least two protrusions formed on the inner surface of the contact hood opening;

an electrical contact having a body including a contact end and a socket end, the socket end inserted axially into the opening of the contact hood, the contact end of the electrical contact configured to extend from a mating end of the connector housing; and at least two apertures formed through the body of the electrical contact on the socket end of the electrical contact, the at least two protrusions received in the at least two apertures to secure the electrical contact within the contact hood.

11. The assembly of claim 10, wherein the at least two protrusions are equally spaced around a circumference of the inner surface of the contact hood and the at least two apertures are equally spaced around a circumference of the socket end of the electrical contact.

12. The assembly of claim 10 comprising two protrusions spaced 180 degrees around a circumference of the inner surface of the contact hood, and two apertures spaced 180 degrees around a circumference of the socket end of the electrical contact.

13. The assembly of claim 10, wherein the socket end of the electrical contact includes tines configured to receive at least one of a wire or a contact.

14. The assembly of claim 10, wherein the contact hood is configured to align the electrical contact with a contact of a mating connector.

15. The assembly of claim 10, wherein the at least two protrusions of the contact hood and the at least two apertures of the electrical contact being preformed prior to inserting the electrical contact into the opening of the contact hood.

16. An electrical contact assembly comprising:

a contact hood having a body including an axis and an opening extending through the body along the axis, the opening having an inner surface including a circumference, the contact hood configured to be received in an opening of a connector housing;

hood fasteners oriented symmetrically around the contact hood opening;

an electrical contact having a body including a contact end and a socket end, the socket end inserted axially into the opening of the contact hood, the contact end of the electrical contact configured to extend from a mating end of the connector housing; and contact fasteners oriented symmetrically around the electrical contact, the contact fasteners comprising apertures extending through the body of the electrical contact, the hood fasteners engaging the contact fasteners to secure the electrical contact within the contact hood.

17. The assembly of claim 16, wherein the hood fasteners include two hood fasteners spaced 180 degrees around the circumference of the inner surface of the contact hood, and the contact fasteners include two contact fasteners spaced 180 degrees around a circumference of the socket end of the electrical contact.

18. The assembly of claim 16, wherein the hood fasteners are formed as protrusions that extend toward the axis of the contact hood body.

19. The assembly of claim 16, wherein the contact fasteners are formed as recesses that receive the hood fasteners of the contact hood.

20. The assembly of claim 16, wherein the hood fasteners of the contact hood and the contact fasteners of the electrical contact being preformed prior to the hood fasteners engaging the contact fasteners to secure the electrical contact within the contact hood.

* * * * *